US006537396B1

(12) United States Patent
Ijames

(10) Patent No.: US 6,537,396 B1
(45) Date of Patent: Mar. 25, 2003

(54) CRYOGENIC PROCESSING OF SPRINGS AND HIGH CYCLE RATE ITEMS

(75) Inventor: Kevin Ijames, Cuba, MO (US)

(73) Assignee: Ace Manufacturing & Parts Company, Sullivan, MO (US)

( * ) Notice: Subject to any disclaimer, the term of this patent is extended or adjusted under 35 U.S.C. 154(b) by 19 days.

(21) Appl. No.: 09/681,201

(22) Filed: Feb. 20, 2001

(51) Int. Cl.[7] ..... C21D 6/04
(52) U.S. Cl. ..... 148/578; 62/62
(58) Field of Search ..... 148/578; 62/62

(56) References Cited

U.S. PATENT DOCUMENTS

| | | | |
|---|---|---|---|
| 2,696,450 A | 12/1954 | Breeler | |
| 2,795,519 A | 6/1957 | Angel et al. | |
| 2,903,386 A | 9/1959 | Waxweiler | |
| 2,958,618 A | 11/1960 | Allen | |
| 3,764,401 A | 10/1973 | Hrusovsky | |
| 3,819,428 A | 6/1974 | Moore | |
| 4,042,423 A | 8/1977 | Van den Sype et al. | |
| 4,161,415 A | 7/1979 | Van den Sype et al. | |
| 4,204,885 A | 5/1980 | Van den Sype | |
| 4,265,679 A | 5/1981 | Ohashi et al. | |
| 4,739,622 A | 4/1988 | Smith | |
| 5,259,200 A | 11/1993 | Kamody | |
| 5,263,886 A | 11/1993 | Workman | |
| 5,447,035 A | 9/1995 | Workman et al. | |
| 5,830,290 A | 11/1998 | Kreipe | |
| 5,865,913 A | 2/1999 | Paulin et al. | |
| 5,993,513 A | 11/1999 | Fife | |
| 6,048,416 A | 4/2000 | Hauser et al. | |
| 6,314,743 B1 * | 11/2001 | Hutchison | 62/62 |

OTHER PUBLICATIONS

Controlled Thermal Processing, Inc., *Research & Metallurgical Analysis for Expanding the Limits of Metal*, accessed Sep. 27, 2000, 4 pages, http://www.metal–wear.com/metal–wear/metallurgical.html.

Controlled Thermal Processing, Inc., *Visit Controlled Thermal Processing's home page to see why we are the best in our field.*, accessed Sep. 27, 2000, 2 pages, http://www.metal–wear.com/metal–wear/abrasion.html.

Controlled Thermal Processing, Inc. & Applied Cryogenics, Inc., *Firearms*, accessed Sep. 27, 2000, 2 pages, http://www.metal–wear.com/metal–wear/guns.html.

* cited by examiner

*Primary Examiner*—Sikyin Ip
(74) *Attorney, Agent, or Firm*—Senniger, Powers, Leavitt & Roedel

(57) ABSTRACT

A clutch disc spring for a land vehicle, such as an over-the-road truck or an automobile, which has an increased life. The spring, formed of ferrous material, is cooled by vaporizing low temperature nitrogen to slowly, cryogenically cool the spring to a temperature of about −300 degrees Fahrenheit and maintain the spring at that temperature for several hours. The cryogenic treatment converts retained austenite within the spring to martensite, thereby improving the mechanical properties of the spring. The spring is then tempered to temper the newly formed martensite, further improving the mechanical properties of the spring. These improved mechanical properties include better wear resistance, strength and resistance to fatigue.

16 Claims, 6 Drawing Sheets

CRYOGENIC PROCESSING OF SPRINGS AND HIGH CYCLE RATE ITEMS

BACKGROUND OF THE INVENTION

This invention generally relates to processes for treating high cycle rate items to improve durability, and more particularly to cryogenic treatment of clutch disc springs processed cryogenically to improve durability and life.

In a land vehicle, such as an over-the-road truck or an automobile, a clutch engages and disengages the transmission with and from the engine. Engaging the clutch transfers power from the engine to the transmission and wheels, while disengaging the clutch allows the engine to rotate independently, without driving rotation of the transmission. As is known, clutches are also employed with engines not used to power land vehicles. In a typical design, a flywheel mounts on the engine and rotates conjointly with the engine's crankshaft while a clutch disc of the clutch rotates with the transmission. A clutch disc is arranged for flatwise engagement with the flywheel when a pressure plate urges the clutch disc against the flywheel. When the clutch disc engages the flywheel and pressure plate, the friction between the clutch disc, flywheel and pressure plate eventually causes the clutch disc to rotate conjointly with the flywheel. Because the clutch disc and flywheel can rotate at significantly different rates when disengaged, there is a significant initial torque when the two are re-engaged. It is necessary to protect the engine and transmission from being damaged by this torque.

Clutch discs may be either rigid or flexible. Flexible clutch discs, the focus of the present invention, typically comprise two parts, an inner hub and an outer friction disc. A plurality of clutch disc springs typically engage the inner hub and the outer friction disc. These springs dampen the impact of engaging the clutch disc with the flywheel and pressure plate. After repeated use, these dampening springs can become weak from fatigue and fail. Moreover, abuse of such springs, by engaging the transmission in an inappropriate-gear (where the flywheel speed greatly differs from transmission speed) or by partially engaging the clutch linkage for extended periods (i.e., riding the clutch), can lead to premature stress and fracture. When a clutch disc spring fails, the functioning of the clutch greatly deteriorates because the spring is unable to absorb the shock of the clutch disc engaging the flywheel and pressure plate. Moreover, the time and expense required to replace such a clutch disc spring or entire clutch disc is undesirable. Therefore, it is the aim of the present invention to provide a clutch disc spring that exhibits improved life and durability to avoid the expense and time associated with failed springs.

BRIEF SUMMARY OF THE INVENTION

Among the several objects and features of the present invention may be noted the provision of a clutch disc spring and clutch incorporating the clutch spring that exhibits improved durability and life; the provision of a method of treating clutch disc spring that significantly improves the durability and life of such a spring; and the provision of such a method that treats other high cycle ferrous items for improved mechanical properties.

Generally, a method of treating clutch disc springs to increase the average number of cycles to failure is disclosed. The method comprises the step of providing at least one clutch disc spring, wherein the spring is formed from steel. The spring is then heated to a temperature in a range from about 1400 degrees Fahrenheit to about 1700 degrees Fahrenheit. The spring is then rapidly quenched to a temperature in a range from about 70 degrees Fahrenheit to about 550 degrees Fahrenheit. The method then tempers the spring to a temperature in a range from about 300 degrees Fahrenheit to about 800 degrees Fahrenheit. The spring is then cooled slowly to a cryogenic treatment temperature of about −300 degrees Fahrenheit over a period of at least about 7 hours. The spring is further maintained at said cryogenic treatment temperature over a period of at least about 15 hours for converting any trace amounts of austenite within the spring into martensite so that the spring is substantially free from austenite. The method then warms the spring slowly from the temperature range over a period of at least about 7 hours. The spring is then tempered at a temperature of about 300 degrees Fahrenheit over a period of at least about one hour.

In another embodiment, a method of treating clutch disc springs is disclosed wherein a spring is provided having been formed from steel partially comprised of trace amounts of austenite. The spring is then cooled slowly from an ambient temperature range to a cryogenic treatment temperature in a range from about 250 degrees Fahrenheit to about −350 degrees Fahrenheit over a period of at least about 7 hours. The spring is then maintained within the cryogenic treatment temperature range over a period of at least about 15 hours. The spring is then warmed from the cryogenic treatment temperature to the ambient temperature range over a period of at least about 7 hours. The spring is then tempered at a temperature in a range from about 280 degrees Fahrenheit to about 400 degrees Fahrenheit over a period of at least about one hour.

In yet another embodiment, a method of treating ferrous items subjected to high cycle rates is disclosed. The method comprises steps similar to those set forth above in the previous embodiment.

Other objects and features of the present invention will be in part apparent and in part pointed out hereinafter.

BRIEF DESCRIPTION OF THE SEVERAL VIEWS OF THE DRAWINGS

Corresponding reference characters indicate corresponding parts throughout the several views of the drawings.

DETAILED DESCRIPTION OF THE INVENTION

Figure 1:
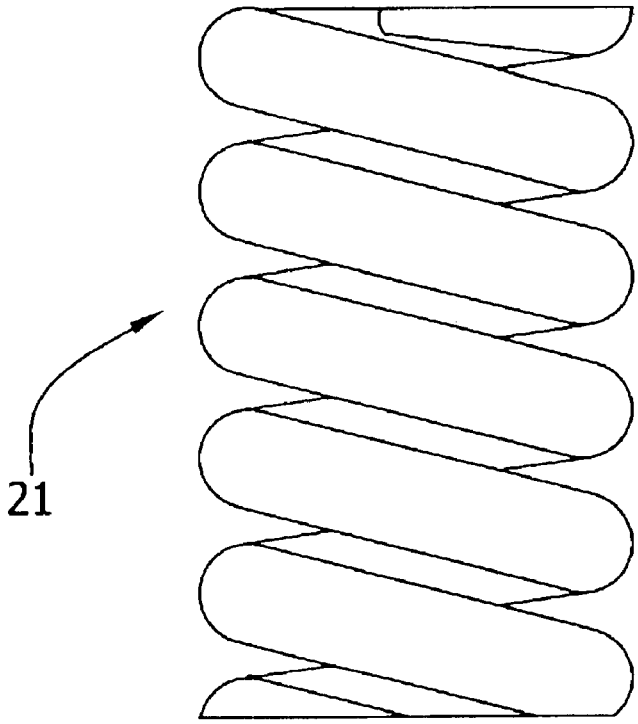
FIG. 1 is a front elevation of the clutch disc spring of the present invention.
Figure 2:
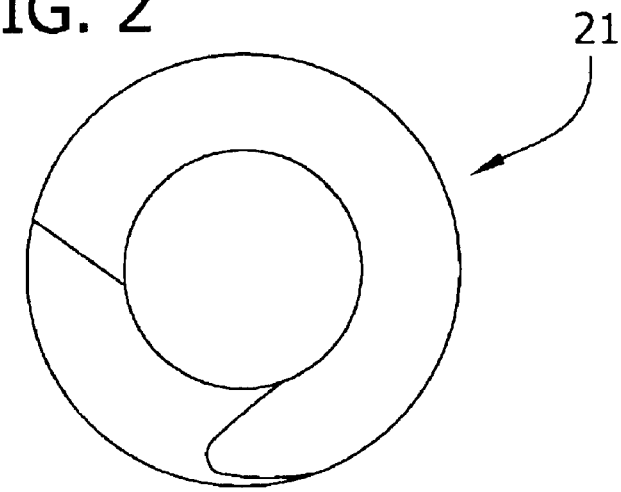
FIG. 2 is a top view of the spring of FIG. 1.
Figure 3:
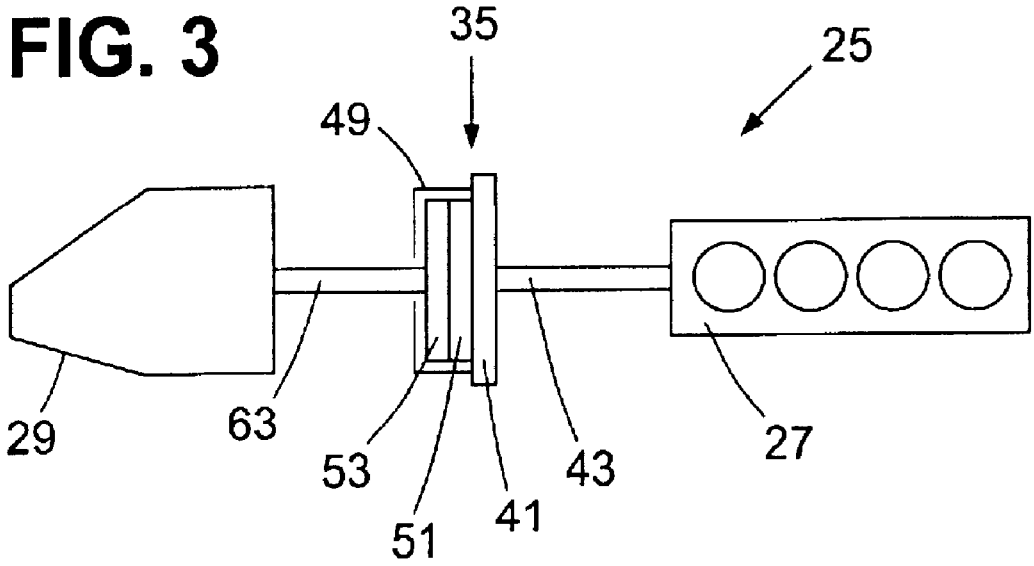
FIG. 3 is a schematic of an engine, clutch and transmission.

Referring now to the drawings and in particular to FIGS. 1–3, a clutch disc spring of the present invention, generally indicated at 21, for mounting within a clutch, generally indicated at 35, is shown. In the preferred embodiment, such a spring 21 or plurality of springs would mount within a clutch 35, such as for use in over-the-road trucks. However, it is contemplated that springs treated according to the present invention could be employed in other applications, such as other vehicles, stationary engines or any application involving a spring having a heavy duty cycle.

FIG. 3 is a schematic of a typical drivetrain, generally indicated at 25, comprising an engine 27, a transmission 29 and the clutch 35. The construction and operation of the drivetrain, including clutch 35, are conventional, except as described below with regard to the clutch springs 21. Thus, only a brief description of the drivetrain will be given. Moreover, variations in drivetrain and clutch construction and operation may be made without departing from the scope of the present invention. Preferably, a flywheel 41 is mounted for conjoint rotation on a crankshaft 43 extending from the engine 27 for transmitting the engine's rotational motion. The clutch 35 includes a clutch cover 49 mountable on the flywheel 41. A clutch disc 51 is disposed within the clutch cover 49 for engaging the flywheel 41. A pressure plate 53, rotating conjointly with the flywheel 41, is disposed within the clutch cover 49 for axial movement to engage or disengage clutch disc 51, pressure plate and flywheel. By engaging the clutch disc 51 with the flywheel 41 and pressure plate 53, the rotational energy of the engine 27 is transmitted to the transmission 29.

Figure 4:
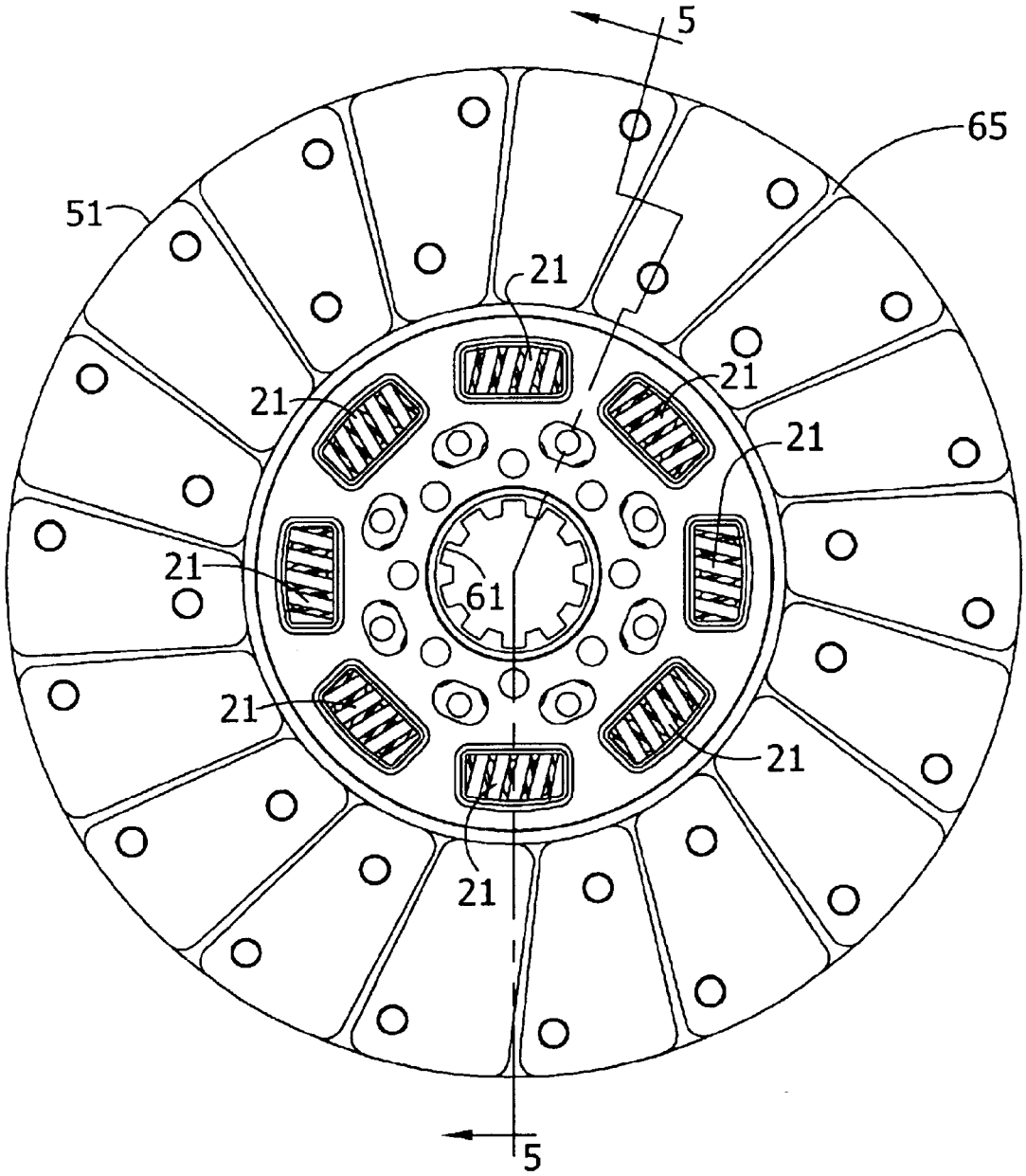
FIG. 4 is a front view of a clutch plate of the present invention.
Figure 5:
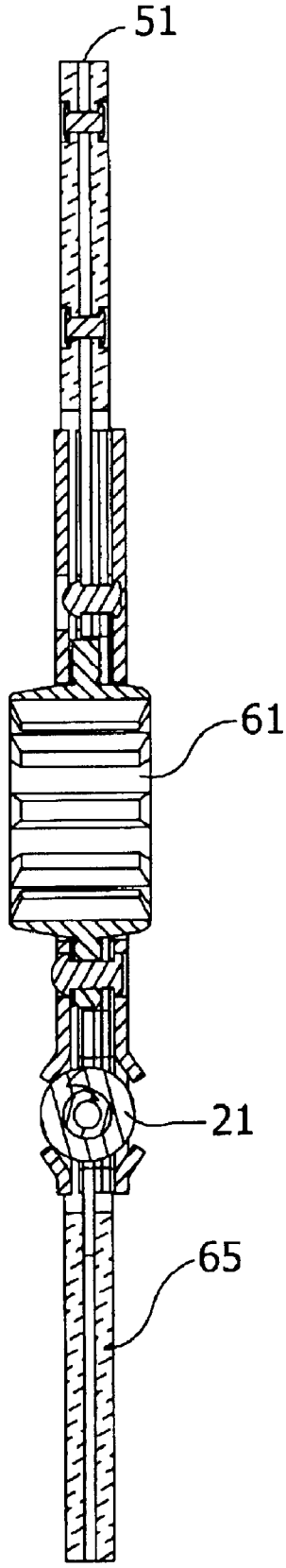
FIG. 5 is a section taken as indicated by line 5—5 of FIG. 4.

Turning to FIGS. 4 and 5, the clutch disc 51 further comprises an inner splined hub 61 engageable with a transmission input shaft 63 and an outer friction disc 65 engageable the flywheel 41. The inner splined hub 61 and outer friction disc 65 are connected together so as to permit a small relative rotation between the two upon engagement with the flywheel. Several of the disc springs 21 are carried by the clutch disc 51 and engaged between the hub 61 and outer friction disc 65 to dampen the shock of engagement of the clutch disc 51 with the flywheel 41. It is to be understood that a single spring 21 could be used without departing from the scope of the present invention. The damping provided by the springs 21 provides for smoother engagement of the flywheel 41 with the pressure plate 53 and clutch disc 51 and helps insulate the transmission 29 from engine surges. The end of each spring 21 engages both the inner hub 61 and the friction disc 65. Should the clutch disc 51 and flywheel 41 engage at the same rotational speed, the springs 21 will remain uncompressed because the outer disc 65 and hub 61 are rotating conjointly, placing no compressive force on the springs. Where the rotational speeds differ, however, the movement of the outer disc 65 relative to the hub 61 will cause the springs 21 to compress, damping the force of the flywheel 41 until the rotational speed of the hub matches the outer disc.

Clutch disc springs 21 are well known in the art. After repeated use, these springs 21 can become weak from fatigue and may break. Moreover, abuse of such springs 21, by engaging the transmission 29 in an inappropriate gear (where the flywheel speed greatly differs from transmission speed) or by partially engaging the linkage for extended periods (i.e., riding the clutch), can lead to premature stress and fracture.

Figure 6:
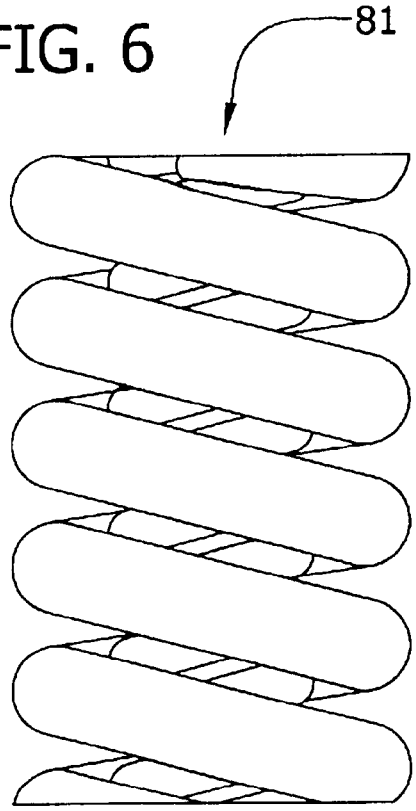
FIG. 6 is a front elevation of another clutch disc spring of the present invention.
Figure 7:
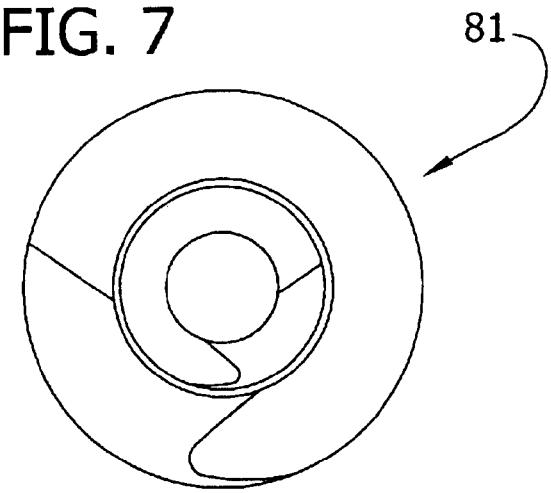
FIG. 7 is a top view of the spring of FIG. 6.
Figure 8:
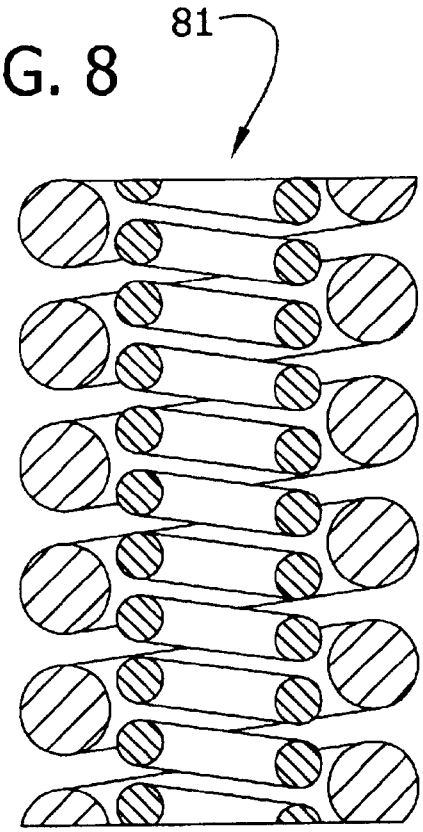
FIG. 8 is a vertical section of the spring of FIG. 6.

Clutch disc springs 21 capable of benefitting from the present invention may take multiple shapes. For instance, the spring depicted in FIGS. 6–8, generally indicated at 81, is formed from a pair of concentrically nested, coil compression springs. Other types of springs may also cooperate with different clutch disc designs without departing from the scope of the present invention (e.g., leaf springs, conical helical springs, belleville washers, etc.).

Figure 9:
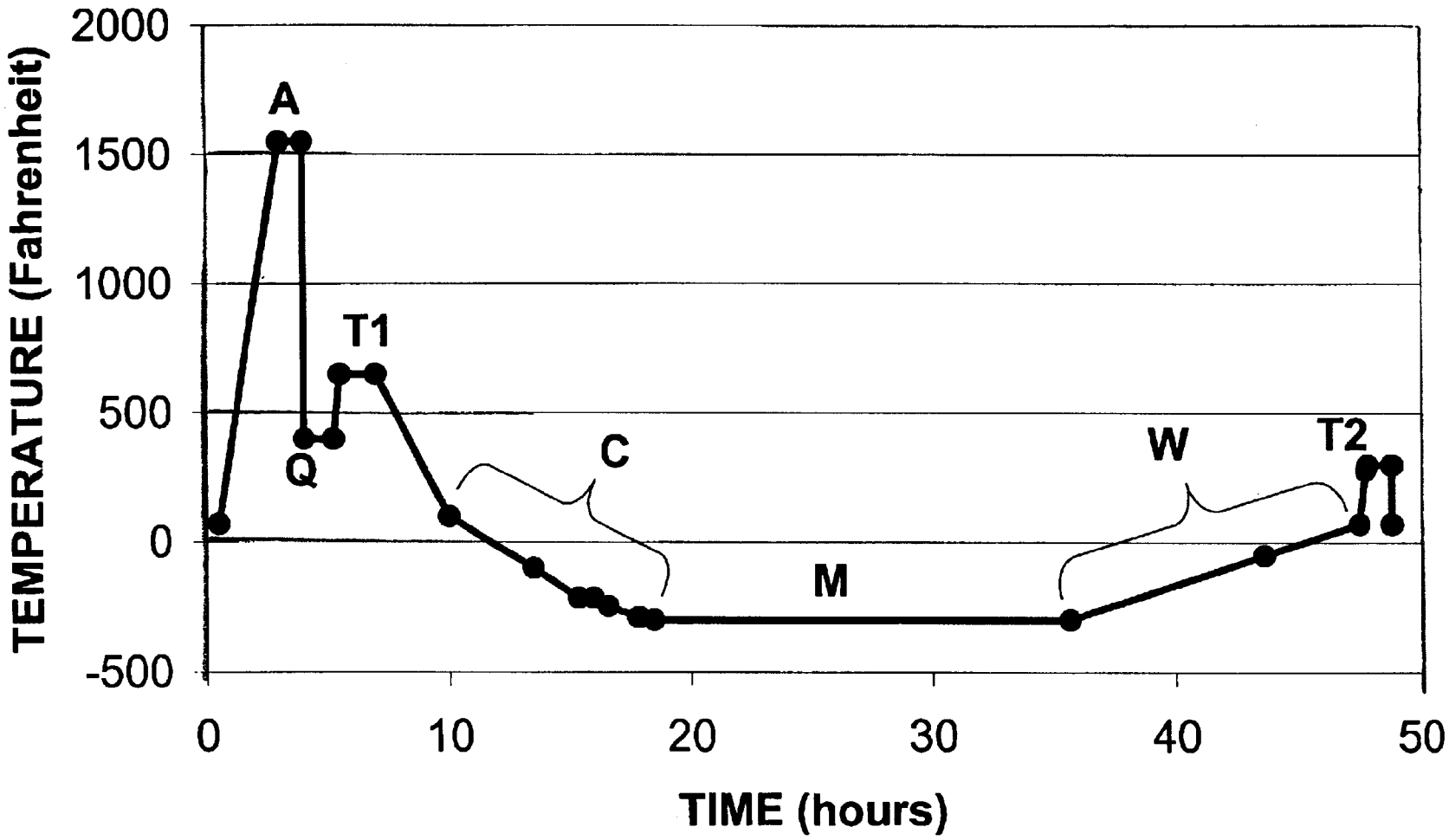
FIG. 9 is a graph depicting the spring temperature profile induced by the method of the present invention.

The method of the present invention is directed to treating clutch disc springs to increase the average number of cycles to failure. Increasing the number of to failure improves spring life and clutch service life. The method comprises several steps, which are depicted in FIG. 9 as a temperature profile of springs during treatment by the present method. FIG. 9 is a temperature profile of a representative treatment process carried out according to the present invention. The figure is set forth for illustrating a single preferred set of steps only and should be construed as such. At least one clutch disc spring, but preferably multiple, are treated at the same time. Typically, the springs are formed from a ferrous material, such as steel, partially comprised of trace amounts of austenite. For example, the spring may be formed from ASTM A877 Chrome, SAEJ157 Chrome, ASTM-A229-77, or any other ferrous material suitable for use in a coil spring. The present method should not be read as limited to any particular ferrous material mentioned herein. To reach such a composition, the springs are hardened by first elevating the temperature to the austenitizing temperature, such as about 1550 degrees Fahrenheit (840 degrees Celsius) depending upon the alloy, where the steel recrystallizes as austenite (marked A in FIG. 9). Secondly, the spring is cooled rapidly from this state, or quenched, thereby converting most of the austenite to martensite, which is desirable because of its superior hardness, wear resistance and strength, compared to austenite (marked Q in FIG. 9). Martensite, however, is very brittle and must therefor be tempered, typically at a temperature from about 300 degrees Fahrenheit (149 degrees Celsius) to about 800 degrees Fahrenheit (430 degrees Celsius), to remove quenching strains and to make it tougher (more shock resistant), while retaining most of its pre-tempered strength and hardness. This step is marked Ti in FIG. 9. Even after such processing, some metal, typically 3 to 5 percent, would remain as austenite, which is undesirable due to its poor wear resistance and strength compared to tempered martensite. The present method converts such trace austenite to tempered martensite to improve the properties of the spring.

The springs 21 are then slowly cooled from an ambient temperature range (e.g., between about 60 degrees Fahrenheit (16 degrees Celsius) and about 100 degrees Fahrenheit (38 degrees Celsius)) to a temperature in a range from about 250 degrees Fahrenheit (−157 degrees Celsius) to about −350 degrees Fahrenheit (−212 degrees Celsius) over a period of at least about 7 hours. Vaporizing low temperature nitrogen cools the springs and lowers their temperature slowly. The springs are preferably held within an insulated container, such as a freezer, while a computer controls the flow of vaporized nitrogen into the freezer (not shown). Temperature sensors within the freezer act as a feedback mechanism for the computer-controlled nitrogen flow, regulating the temperature in the freezer. The temperatures referenced herein for cryogenic treatment are the internal temperatures of the freezer. A device designed for such controlled cooling is the "300F C O-Processor" available from 300 Below, Inc. of Decatur, Ill., U.S.A. Similar devices capable of providing comparable cooling rates are also available from other manufacturers. Moreover, other methods of cooling, such as a liquid nitrogen bath or other supercooled gaseous or liquid mediums, are also contemplated as within the scope of the present invention. The cooling may occur over an appreciably longer time without departing from the scope of the present invention. More particularly, an average cooling rate is preferably within a range from about 33 degrees Fahrenheit per hour (18 degrees Celsius per hour) to about 62 degrees Fahrenheit per hour (34 degrees Celsius per hour). More preferably, the spring is cooled at an average cooling rate of about 47 degrees Fahrenheit per hour (26 degrees Celsius per hour). The cooling step corresponds to the portion of the curve marked C in FIG. 9.

Once the springs are cooled to the desired temperature range, the freezer and computer maintain them within the temperature range over a period of at least about 15 hours. Extended periods at this temperature convert trace austenite within the springs into martensite. After this maintaining step, the spring is substantially free from austenite. In addition, the springs' crystal structure before treatment often includes micro-voids, which can create weak points within the springs. The maintaining step removes these micro-voids within the crystal structure of the springs, further enhancing the springs' mechanical properties. Preferably, the maintaining step lasts at least about 17 hours, giving the retained austenite ample time to convert to martensite. More particularly, the cooling step maintains the springs within a temperature range from about −280 degrees Fahrenheit (−173 degrees Celsius) to about −320 degrees Fahrenheit (−196 degrees Celsius). In the preferred embodiment, the cooling step maintains the springs at a temperature of about −300 degrees Fahrenheit (−184 degrees Celsius). The maintaining step corresponds to the portion of the curve marked M in FIG. 9.

Once the retained austenite changes to martensite, the method includes a warming step where the springs are warmed slowly from the maintaining temperature, or temperature range, to an ambient temperature range over a period of at least about 7 hours. The warming may occur over an appreciably longer time without departing from the scope of the present invention. More particularly, an average warming rate is preferably within a range from about 22 degrees Fahrenheit per hour (12 degrees Celsius per hour) to about 40 degrees Fahrenheit per hour (22 degrees Celsius per hour). More preferably, the spring is warmed at an average warming rate of about 31 degrees Fahrenheit per hour (17 degrees Celsius per hour). The warming step corresponds to the portion of the curve marked W in FIG. 9.

Once warmed, the method provides a final tempering step to temper the newly formed martensite. As discussed above, tempering the martensite improves its mechanical properties by removing residual strains within the springs. The tempering step heats the springs to a temperature range from about 280 degrees Fahrenheit (138 degrees Celsius) to about 400 degrees Fahrenheit (204 degrees Celsius) over a period of at least about one hour. More particularly, the tempering step maintains the springs within a temperature range from about 280 degrees Fahrenheit (138 degrees Celsius) to about 320 degrees Fahrenheit (160 degrees Celsius). Preferably, the tempering step maintains the springs at a temperature of about 300 degrees Fahrenheit (149 degrees Celsius). The tempering step corresponds to the portion of the curve marked T2 in FIG. 9. Moreover, the tempering step may be repeated multiple times to further temper the newly formed martensite within the springs, although a single tempering step, as shown in FIG. 9, is preferred.

In the preferred embodiment, the cooling, maintaining and warming steps collectively take a minimum of 36 hours to complete. A longer period is also contemplated as within the scope of the present invention. Treating springs according to the method of the present invention is believed to ensure that the springs contain less than about 5 percent retained austenite by volume. More particularly, the springs are believed to contain less than about 3 percent retained austenite by volume. Most likely, however, the springs are believed to contain substantially no austenite. Treated springs have a more uniform structure, making them more wear resistant, stronger and more fatigue resistant. For example, treating springs according to the present method increases the average fatigue life of the springs at least two times as compared to untreated clutch disc springs of otherwise identical construction. Usually, the method increases the fatigue life of the springs at least three times as compared to untreated clutch disc springs of otherwise identical construction. In a representative experiment conducted upon an untreated spring (i.e., a spring receiving only the conventional heat treatment through step T1), the spring withstood 2,280,600 cycles before failing. In contrast, a spring treated according to the present method and subsequently fatigue tested withstood 6,923,700 cycles before failure. Moreover, two other treated springs withstood 6,060,600 and 10,521,000 cycles, respectively, before fatigue testing ended without failure of the springs.

The method of the present invention is also applicable to other ferrous items that may be subjected to high cycle rates. High cycle rate items are those items subjected to repeated fatigue and stress (and frequently substantial deformation) due to frequent cycling over extended time periods, such as used within a clutch. As with clutch disc springs, the current method will increase the average number of cycles to failure and improve the overall material characteristics of high cycle items.

In view of the above, it will be seen that the several objects of the invention are achieved and other advantageous results attained.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A method of treating clutch disc springs to increase the average number of cycles to failure, the method comprising the following steps:

providing at least one clutch disc spring, said spring being formed from steel;

heating said at least one spring to a temperature in a range from about 1400 degrees Fahrenheit to about 1700 degrees Fahrenheit;

quenching said at least one spring rapidly to a temperature in a range from about 70 degrees Fahrenheit to about 550 degrees Fahrenheit;

tempering said at least one spring to a temperature in a range from about 300 degrees Fahrenheit to about 800 degrees Fahrenheit;

cooling said at least one spring slowly to a cryogenic treatment temperature of about −300 degrees Fahrenheit over a period of at least about 7 hours;

maintaining said at least one spring at said cryogenic treatment temperature over a period of at least about 15 hours for converting any trace amounts of austenite within said at least one spring into martensite so that the spring is substantially free from austenite;

warming said at least one spring slowly from said cryogenic treatment temperature over a period of at least about 7 hours; and tempering said at least one spring at a temperature of about 300 degrees Fahrenheit over a period of at least about one hour.

2. The method of claim 1 wherein the maintaining step has a duration of at least about 17 hours.

3. The method of claim 2 wherein the cooling, maintaining and warming steps collectively are carried out in no less than about of 36 hours.

4. The method of claim 3 wherein the heating step comprises heating said at least one spring to a temperature of about 1550 degrees Fahrenheit.

5. A method of treating clutch disc springs to increase the average number of cycles to failure, the method comprising the following steps:

providing at least one spring, said spring being formed from steel including at least trace amounts of austenite;

cooling said at least one spring slowly from an ambient temperature to a cryogenic treatment temperature in a range from about 250 degrees Fahrenheit to about −350 degrees Fahrenheit over a period of at least about 7 hours;

maintaining said at least one spring within said cryogenic treatment temperature range over a period of at least about 15;

warming said at least one spring slowly from said cryogenic treatment temperature to said ambient temperature range over a period of at least about 7 hours; and tempering said at least one spring at a temperature in a range from about 280 degrees Fahrenheit to about 400 degrees Fahrenheit over a period of at least about one hour.

6. The method of claim 5 wherein the maintaining step has a duration of at least about 17 hours.

7. The method of claim 6 wherein the cooling, maintaining and warming steps collectively are carried out in no less than about 36 hours.

8. The method of claim 7 wherein the cryogenic treatment temperature range of the cooling step is from about −280 degrees Fahrenheit to about −320 degrees Fahrenheit.

9. The method of claim 8 wherein the cryogenic treatment temperature of the cooling step is about −300 degrees Fahrenheit.

10. The method of claim 7 wherein the tempering step includes maintaining said at least one spring within a temperature range from about 280 degrees Fahrenheit to about 320 degrees Fahrenheit.

11. The method of claim 10 wherein the tempering step includes maintaining said at least one spring at a temperature of about 300 degrees Fahrenheit.

12. The method of claim 7 wherein the cooling step comprises cooling said at least one spring at an average rate within the range from about 33 degrees Fahrenheit per hour to about 62 degrees Fahrenheit per hour.

13. The method of claim 12 wherein the cooling step comprises cooling said at least one spring at an average rate of about 47 degrees Fahrenheit per hour.

14. The method of claim 7 wherein the warming step includes warming said at least one spring at an average rate within the range from about 22 degrees Fahrenheit per hour to about 40 degrees Fahrenheit per hour.

15. The method of claim 14 wherein the warming step includes warming said at least one spring at an average rate of about 31 degrees Fahrenheit per hour.

16. The method of claim 5 wherein said at least one spring comprises a pair of concentric coil springs.

* * * * *

UNITED STATES PATENT AND TRADEMARK OFFICE

CERTIFICATE OF CORRECTION

PATENT NO. : 6,537,396 B1
DATED : March 25, 2003
INVENTOR(S) : Kevin Ijames

It is certified that error appears in the above-identified patent and that said Letters Patent is hereby corrected as shown below:

Column 2,
Line 22, “250 degrees” should read -- -250 degrees. --

Column 4,
Line 44, “250 degrees” should read -- -250 drgrees. --

Column 7,
Line 22, “250 degrees” should read -- -250 degrees. --

Signed and Sealed this

Twenty-third Day of September, 2003

JAMES E. ROGAN
*Director of the United States Patent and Trademark Office*